US005975803A

United States Patent [19]

Mackinnon

[11] Patent Number: 5,975,803

[45] **Date of Patent: *Nov. 2, 1999**

[54] SYSTEM AND METHOD FOR CONNECTING TOGETHER TWO ASSEMBLIES WHICH CAN MOVE ONE WITH RESPECT TO THE OTHER, ESPECIALLY IN UNDERWATER INSTALLATIONS

[75] Inventor: Calum Mackinnon, Aberdeen, United Kingdom

[73] Assignee: Coflexip, France

[ * ] Notice: This patent issued on a continued prosecution application filed under 37 CFR 1.53(d), and is subject to the twenty year patent term provisions of 35 U.S.C. 154(a)(2).

[21] Appl. No.: 09/083,744

[22] Filed: May 22, 1998

[30] Foreign Application Priority Data

May 23, 1997 [FR] France ..... 97 06314

[51] Int. Cl.[6] ..... F16L 1/04; E21B 7/12

[52] U.S. Cl. ..... 405/169; 166/343; 166/347; 405/170; 405/191

[58] Field of Search ..... 405/169–171, 405/158, 159, 191, 192, 188; 166/338, 343, 349, 339, 341

[56] References Cited

U.S. PATENT DOCUMENTS

| | | | |
|---|---|---|---|
| 3,721,294 | 3/1973 | Nelson | 166/343 X |
| 4,086,778 | 5/1978 | Latham et al. | 405/169 |
| 4,459,065 | 7/1984 | Morton | 405/169 |
| 4,591,292 | 5/1986 | Stevens et al. | 405/169 |
| 4,906,136 | 3/1990 | Norbom et al. | 405/191 X |
| 5,501,549 | 3/1996 | Breda et al. | 405/169 |
| 5,593,249 | 1/1997 | Cox et al. . | |
| 5,730,551 | 3/1998 | Skeels et al. | 405/170 |
| 5,807,027 | 9/1998 | Ostergaard | 405/170 X |

FOREIGN PATENT DOCUMENTS

| | | |
|---|---|---|
| 2307288 | 5/1997 | United Kingdom . |
| 96/38688 | 12/1996 | WIPO . |

OTHER PUBLICATIONS

"Esso Does It Without Divers In Low Cost Cluster", Offshore Engineer, Apr. 1990, pp. 71 and 73–74.

*Primary Examiner*—Dennis L. Taylor

[57] ABSTRACT

System and method for joining together two assemblies which can move one with respect to the other, especially in underwater installations, comprising a remote-operated vehicle (17) comprising propulsion means (21) and at least one equipment item (19, 20) including hauling means (20) which attach to the assembly considered as being fixed (2) during connection, means of attaching to the other assembly considered as being mobile and which has to be connected to the said fixed assembly, means (19) of winching the said hauling means, the said equipment item being at least partially housed in a skid (18), characterized in that the remote-operated vehicle (17) further comprises a front chassis (22) that pivots about a pivot axis, the said pivoting chassis comprising the said means of attachment to the mobile assembly, the pivoting of the said front chassis being controlled in such a way that as the mobile assembly is moved towards the fixed assembly, the said vehicle is kept constantly in an approximately horizontal position.

33 Claims, 11 Drawing Sheets

Figure 1:
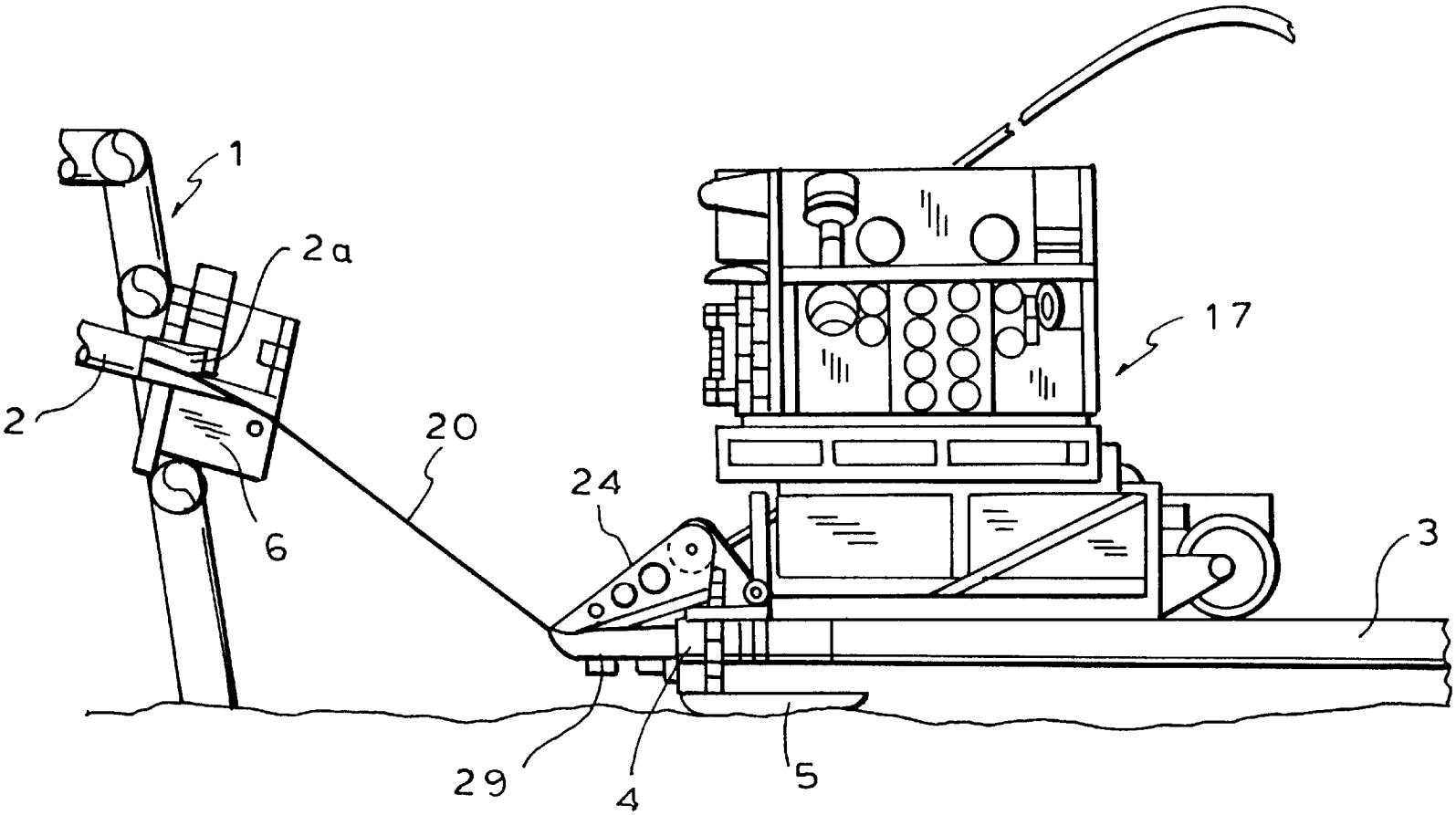

SYSTEM AND METHOD FOR CONNECTING TOGETHER TWO ASSEMBLIES WHICH CAN MOVE ONE WITH RESPECT TO THE OTHER, ESPECIALLY IN UNDERWATER INSTALLATIONS

The present invention relates to a system for connecting together a fixed or temporarily fixed assembly and a mobile assembly, especially in underwater installations, and to a method for connecting together in a leaktight fashion two ends of two separate pipes that can move one with respect to the other.

A fixed assembly should be understood to mean any stationary assembly such as an exploration oil well head, a manifold connected to a collection of well heads, or alternatively part of a fixed installation anchored to the sea bed, such as, for example, a flexible pipe which is considered as being fixed at the moment of connection, these elements being mentioned by way of example.

A mobile assembly should be understood to mean any assembly which is initially situated some arbitrary distance from the fixed assembly to which it is to be connected. The mobile assembly may, for example, consist of the end of a flexible pipe lying on the sea bed or on a sled, and the other end of which is connected, for example, to an underwater production device or a spoolpiece.

In the oil industry, and more specifically in offshore oil production far out at sea, the underwater installations are sometimes at very great depths reaching 1000 m and even more. In order to make connections between various assemblies of the underwater installations, without having to resort to divers or similar techniques, increasing use is being made of certain types of Remote-Operated Vehicle (ROV) which are capable of transporting and/or moving loads of some weight and of carrying out various and varied operations such as making connections between elements and underwater installations.

One of the best known connection systems is the one known as DMaC (which stands for Diverless Maintained Cluster) and described in the journal OFFSHORE ENGINEER, April 1990, p. 71–74: OC 6720, p.209–220.

There are other connection systems, such as the one marketed by the company SON SUB, under the reference DFCS (Diverless Flowline Connection System). The DFCS uses an ROV and a hauling cable allowing the mobile element to be guided towards the fixed element.

The known connection systems are produced in such a way that the connection means are mounted in an end device which is secured to the fixed assembly. When leak tests performed prior to the operational use of the pipeline or periodically during service reveal a defect, it is necessary for the connection means, and in particular the seals, to be repaired or changed. This means that one or more complicated and very expensive interventions are essential because the members requiring the intervention or interventions are located inside the fixed assembly.

Another system, such as the one marketed by the company KONGSBERG OFFSHORE, proposes special means for anchoring to the fixed structure on which the fixed end of a pipe is mounted, a hauling cable payed out from a winch which is mounted on a remote-operated vehicle (ROV)

In an application filed in the name of the applicant company but which has not yet been published, it is proposed that the sealing and locking means be integrated into a floating cassette which constitutes an interface between the ends of the pipes to be connected, the said cassette also playing a part in guiding and in centering the said ends to be connected. However, users sometimes prefer to mount the locking means either on the fixed end before connecting or on both ends after connecting.

In all cases where a remote-operated vehicle is used, the latter, having anchored the hauling cable or cables to the fixed structure, goes to take hold of the mobile end which is generally laid on the sea bed in order to move it towards the fixed structure which comprises the fixed end of the pipe to be connected to the mobile pipe. In some underwater configurations, the pipes to be connected are in approximately the same horizontal plane, generally the sea bed. In other configurations, the pipes to be connected are in markedly different planes, as is the case when the fixed pipe is mounted on an underwater well head or a manifold.

Irrespective of the configuration, the vehicle has to attach itself to a sled on which the end of the mobile pipe is securely mounted. This attachment may be achieved directly by attaching the lower part of the vehicle, hereafter referred to as a skid, and which at least partially contains equipment comprising one or more winches, hauling cables, and possibly operating rams. Another way of attaching the vehicle to the sled is first of all to attach the skid to the sled and then to proceed with connecting the vehicle to the skid. Once the hauling cables have been anchored on the fixed assembly or structure, and once the vehicle has been secured to the sled, the phase of transporting the mobile pipe towards the end of the fixed pipe begins. When the pipes are at different levels, the mobile pipe is raised and transported towards the fixed pipe. During the lifting phase, the vehicle rears up by tipping backwards, the angle of inclination made by the vehicle with respect to a horizontal direction approximately parallel to the sea bed increasing as the vehicle nears the fixed structure. The tipping of the rear part of the vehicle or of the skid secured to it has rather severe consequences which depend on where the vehicle hits. When the rear of the latter hits the mobile pipe, it may cause damage to the said pipe. When the rear digs into the sea bed, and when the latter is loose, for example of the muddy type, then the vehicle may also suffer damage and in any case has to develop a great deal of force in order to pull itself out. Furthermore, as the motor or motors, generally with propeller screws, are running and blowing from front to back, this produces a cloud of particles right around the vehicle which, in the final approach to the fixed structure, may fall down at least partly over the locking means when the latter are mounted on the fixed pipe prior to the connecting of the two ends. The ingress of even a small amount of particles into the locking means may lead to defective sealing and even premature wear of the said locking means.

The object of the present invention is to overcome the aforementioned drawbacks and to propose a system and a method for connecting together two ends of pipes which are simple to employ and allow the connection to be made in complete safety.

One subject of the present invention relates to a system for connecting together two assemblies which can move one with respect to the other, of the type comprising a remote-operated vehicle comprising propulsion means and at least one equipment item including hauling means which attach to the assembly considered as being fixed during connection, means of attaching to the other assembly considered as being mobile and which has to be connected to the said fixed assembly, means of winching the said hauling means, the said equipment item being at least partially housed in a skid, characterized in that the remote-operated vehicle further comprises a front chassis that rotates about a pivot axis, the said front chassis comprising the said means of attachment to the mobile assembly, the pivoting of the said front chassis being controlled in such a way that as the mobile assembly is moved towards the fixed assembly, the said vehicle is kept constantly in an approximately horizontal position.

According to another feature of the invention, the pivoting chassis comprises the operating rams. Thus, the axis of each ram piston is always parallel to that of the guide and centering members attached to the mobile assembly.

Figure 2A:
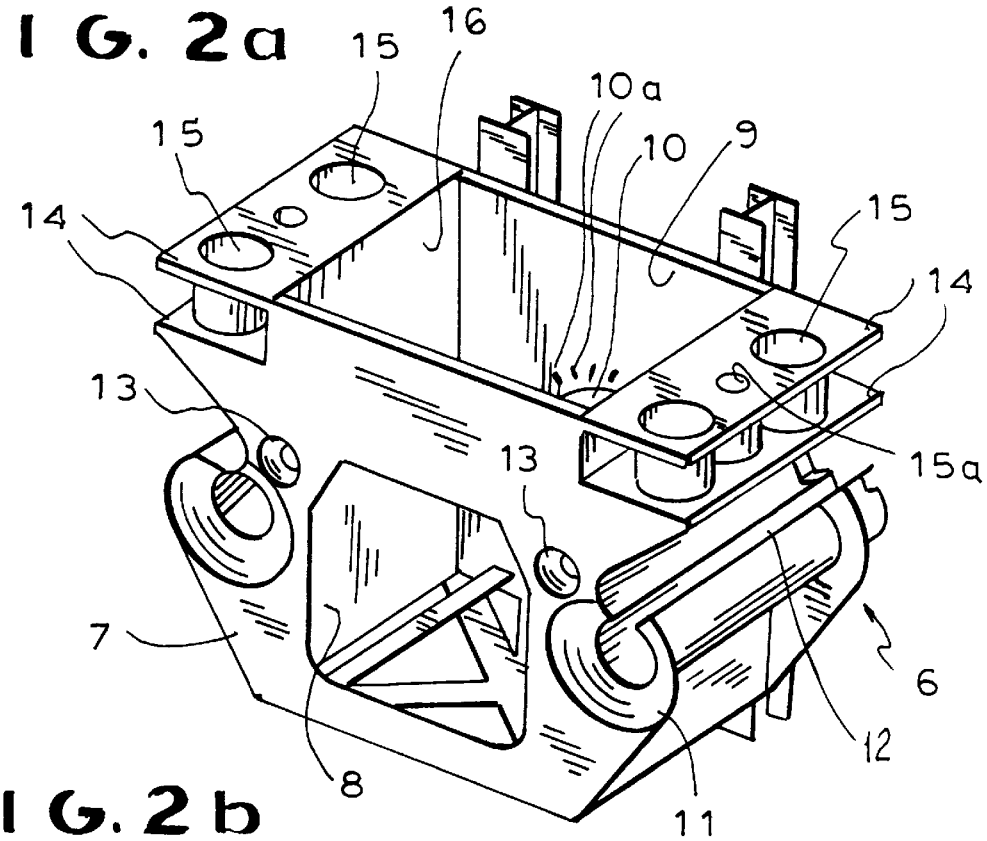
Figure 2B:
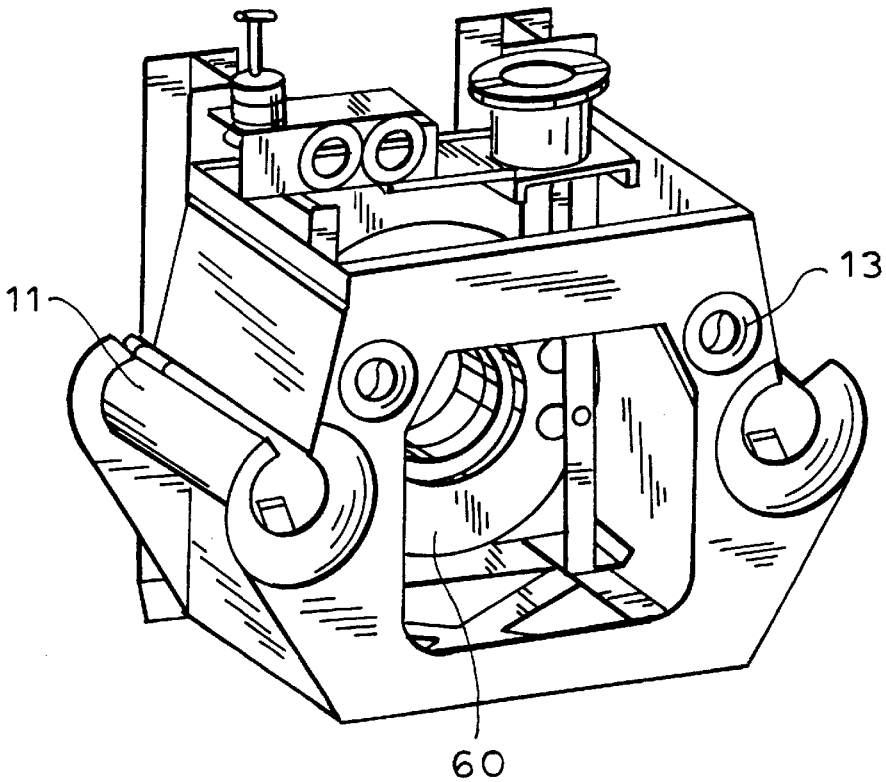
Figure 3A:
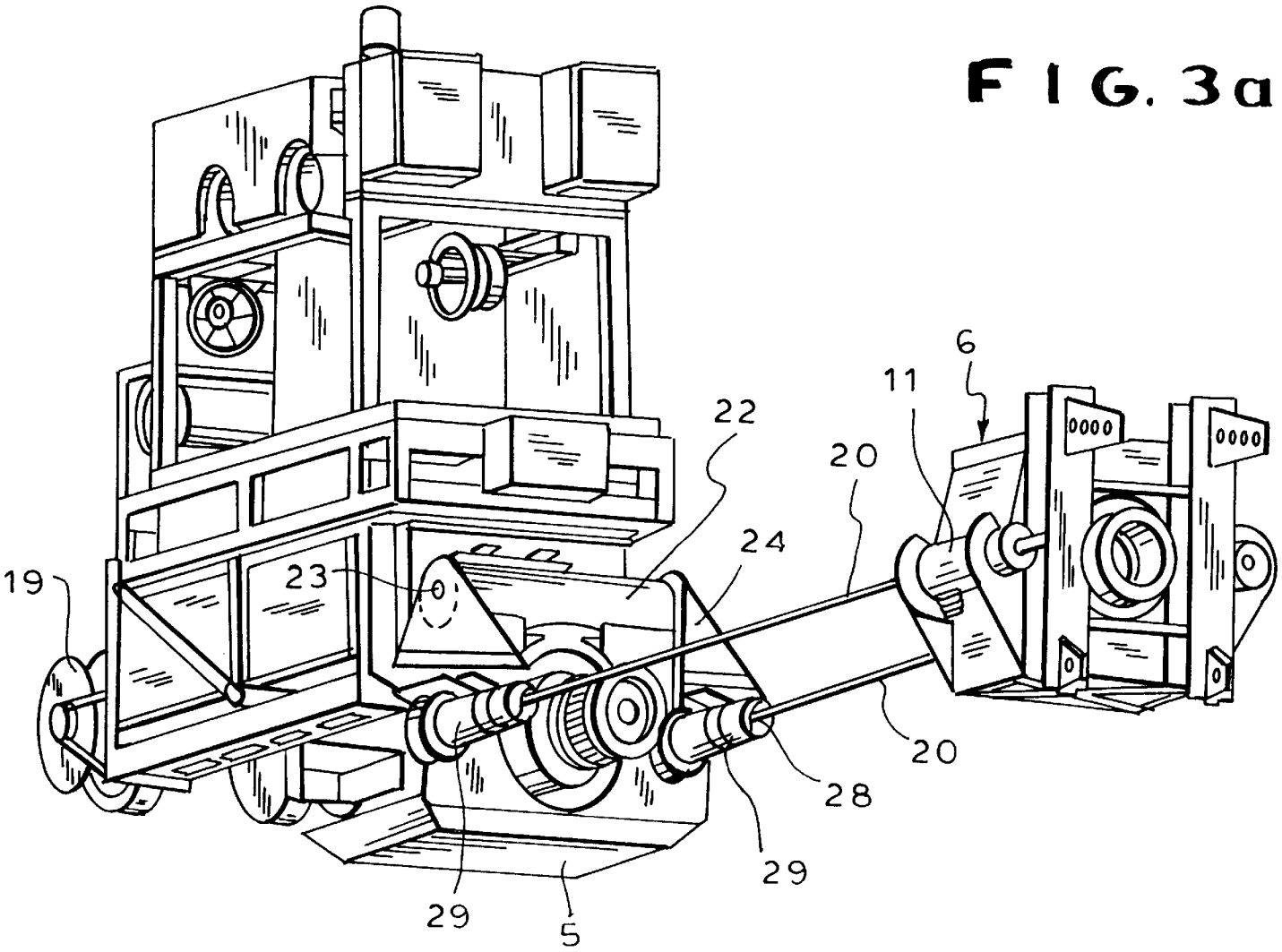
Figure 3B:
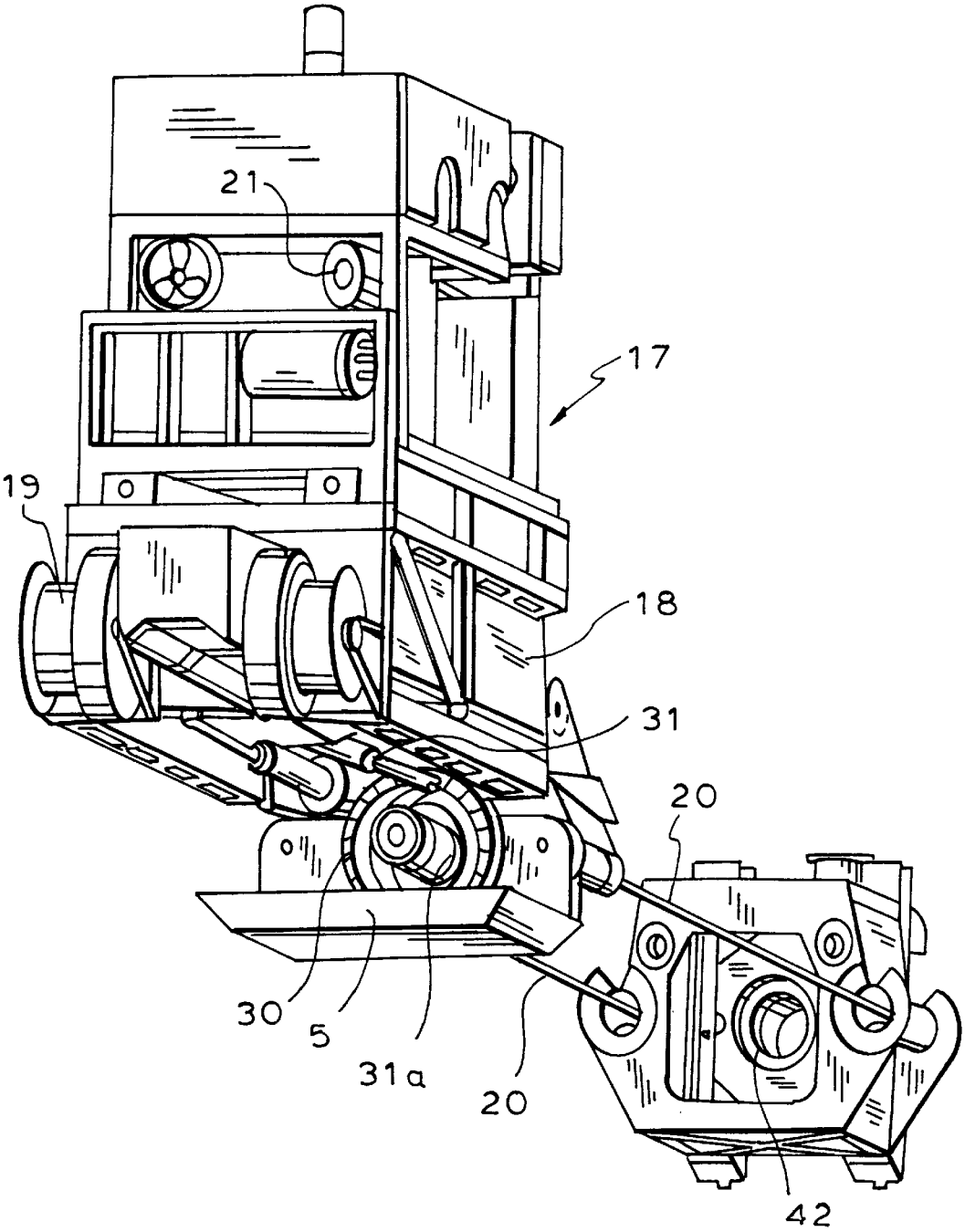
Figure 4:
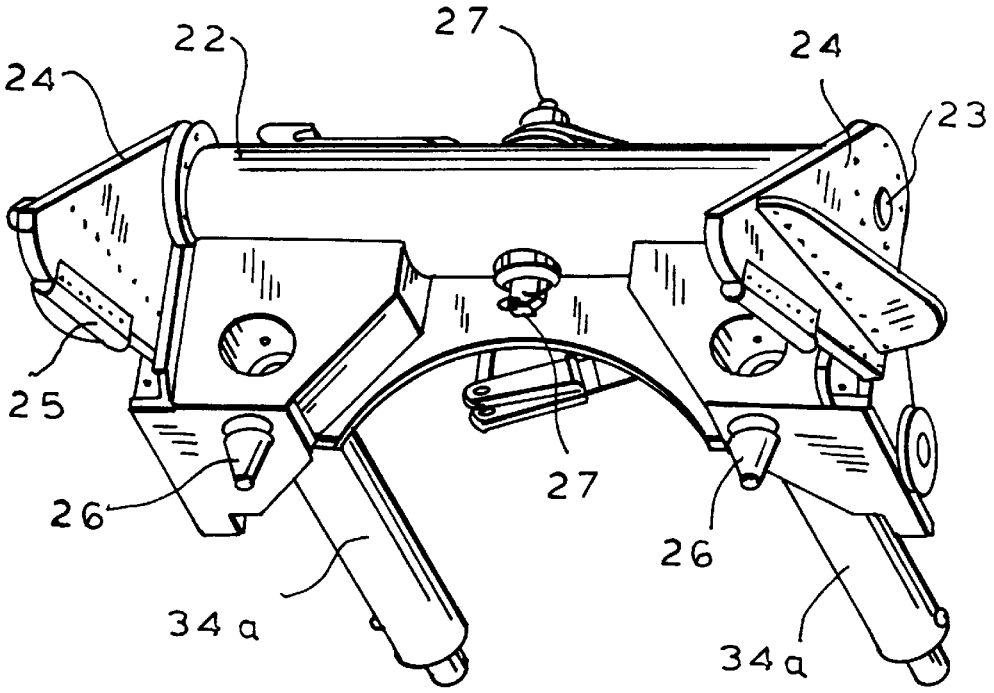
Figure 5:
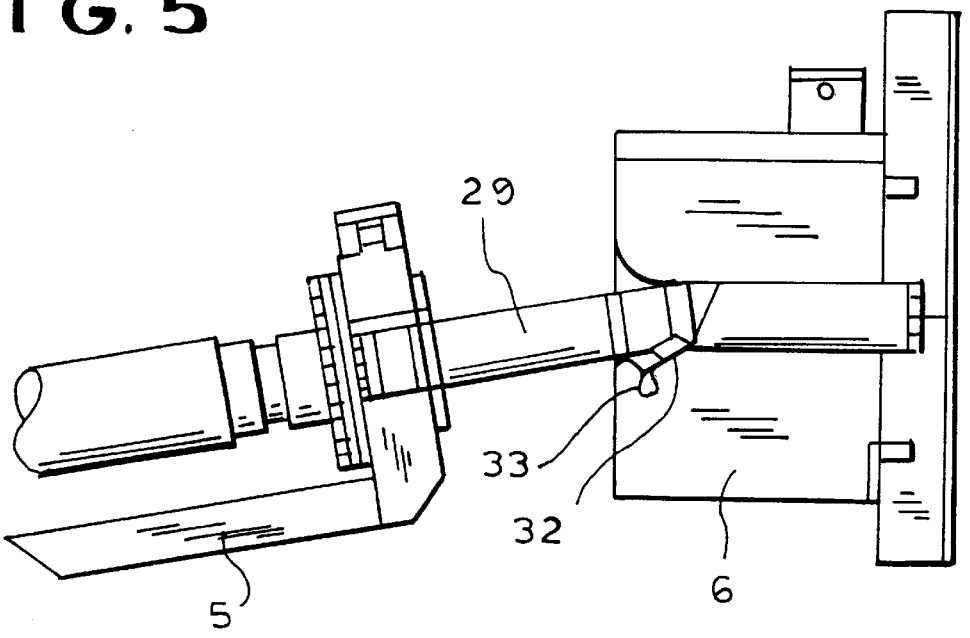
Figure 6:
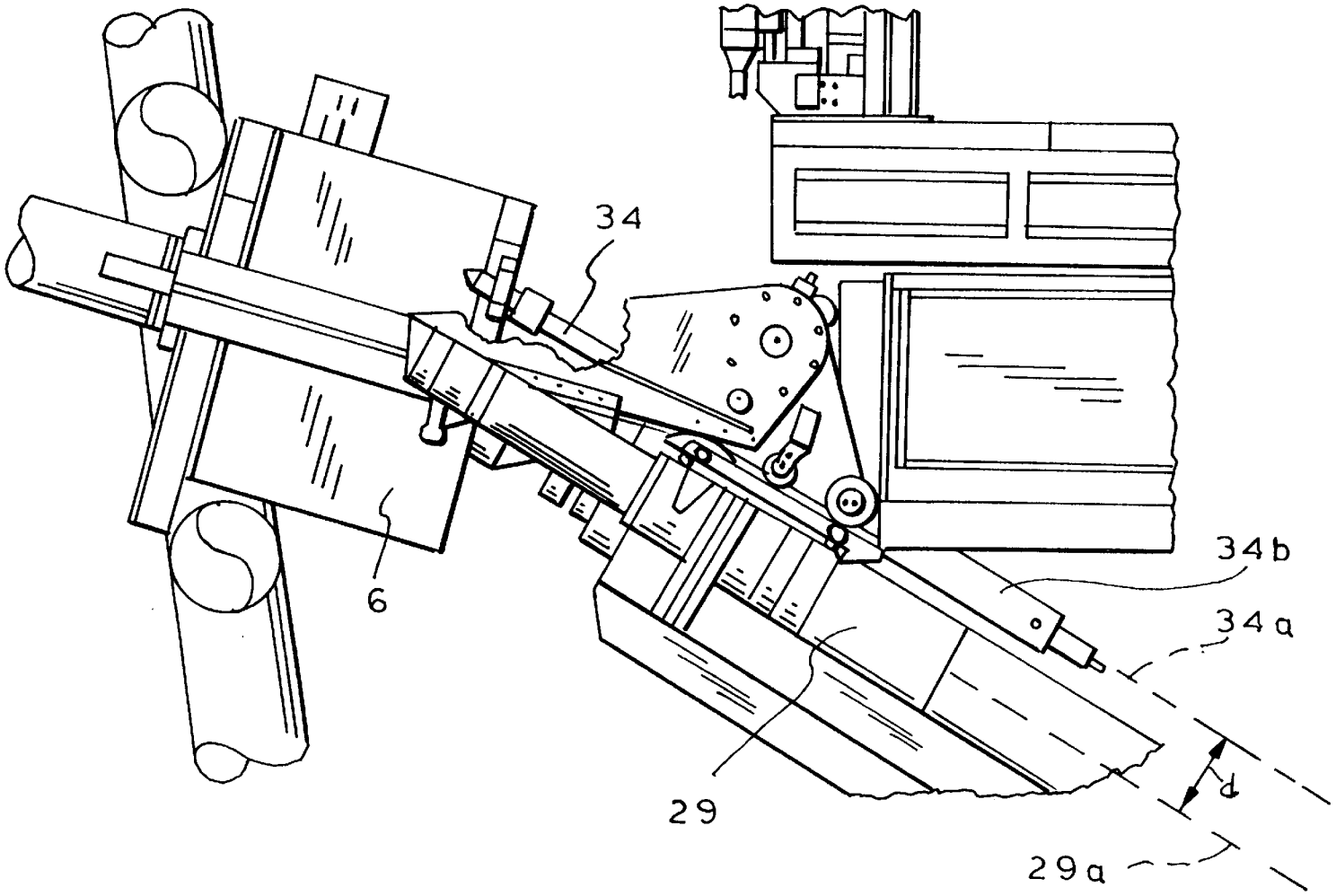
Figure 7:
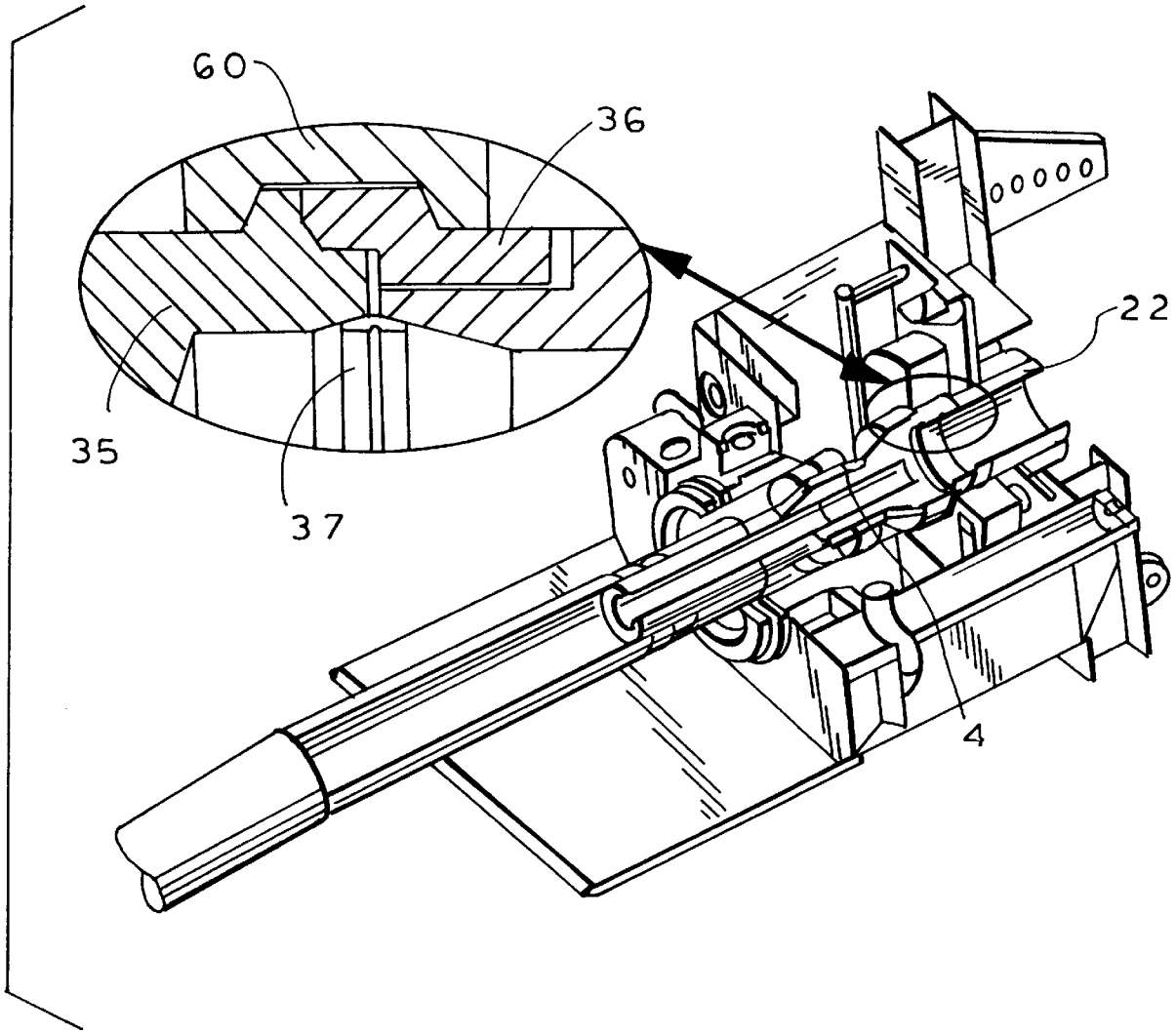
Figure 8:
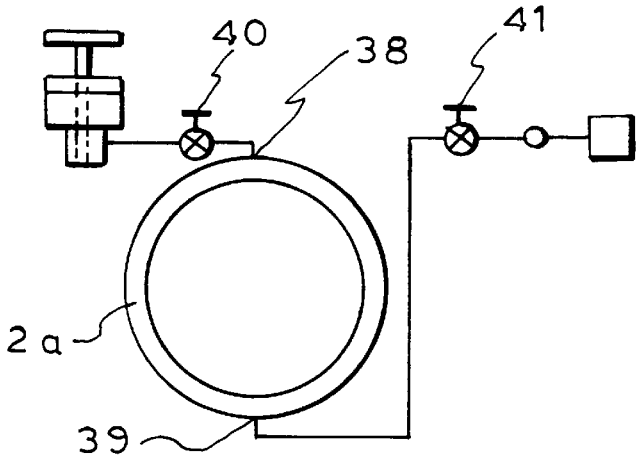
Figure 9A:
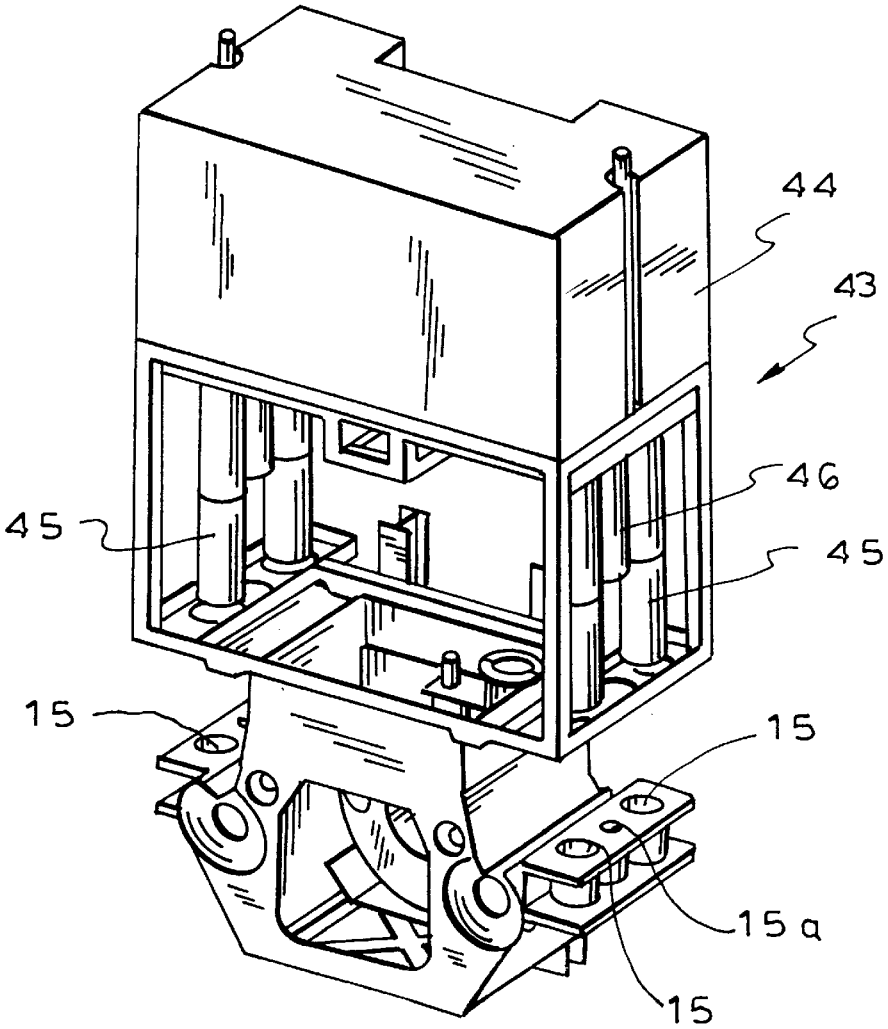
Figure 9B:
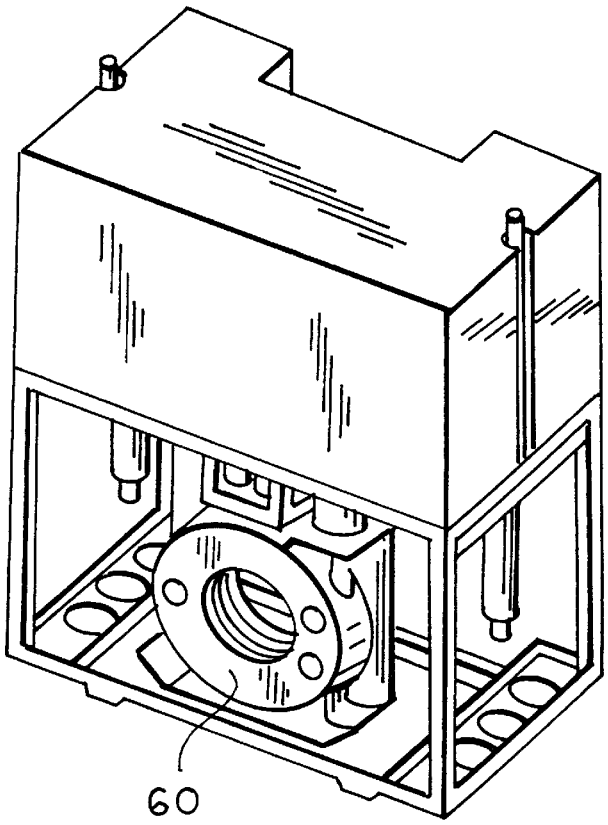
Figure 9B:
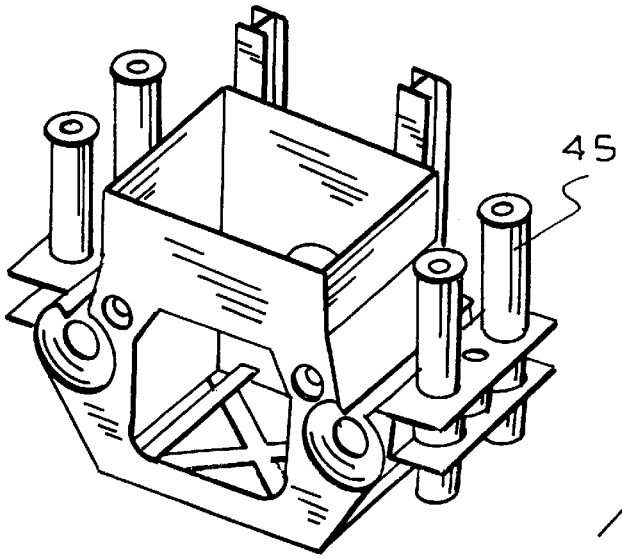
Figure 10A:
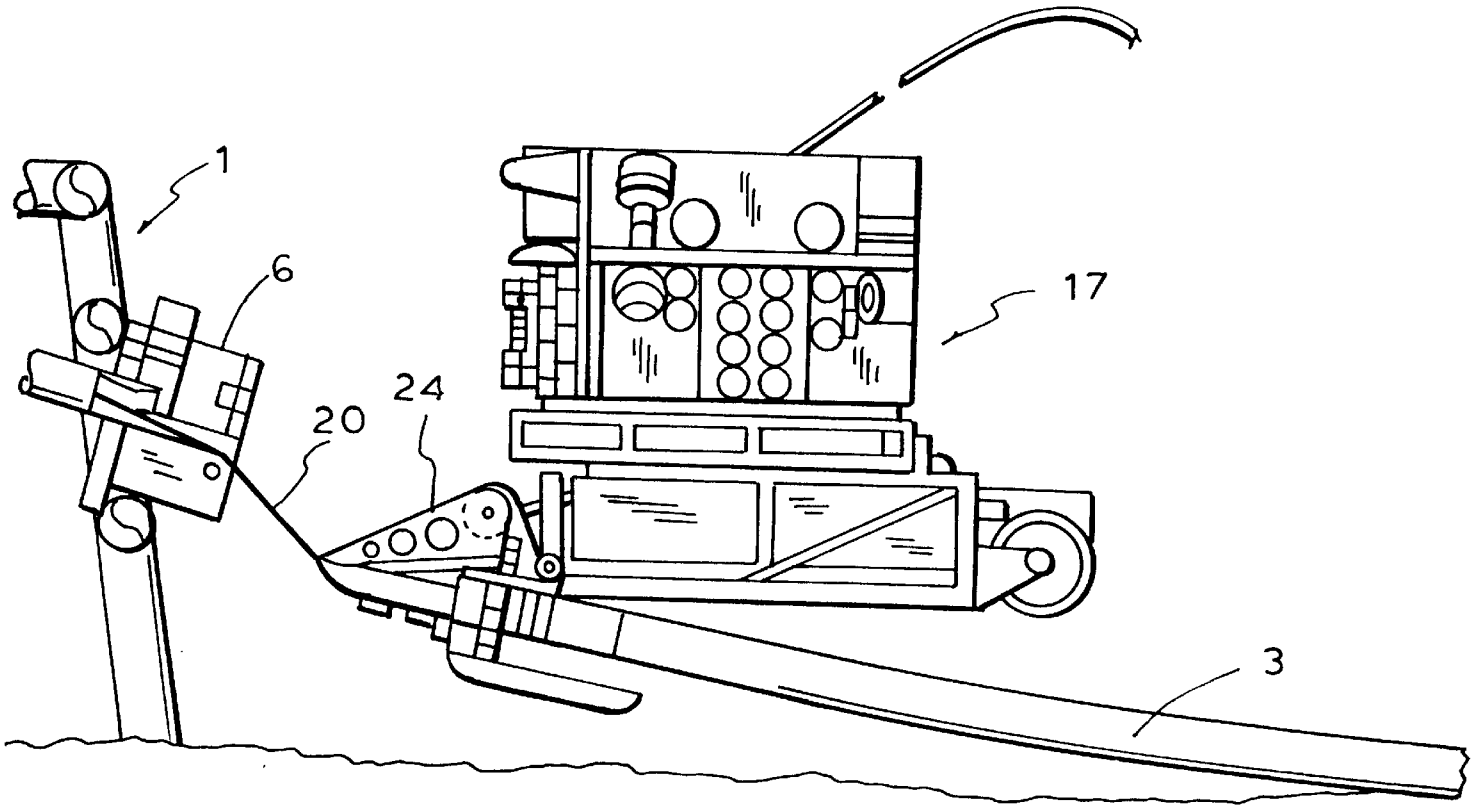
Figure 10B:
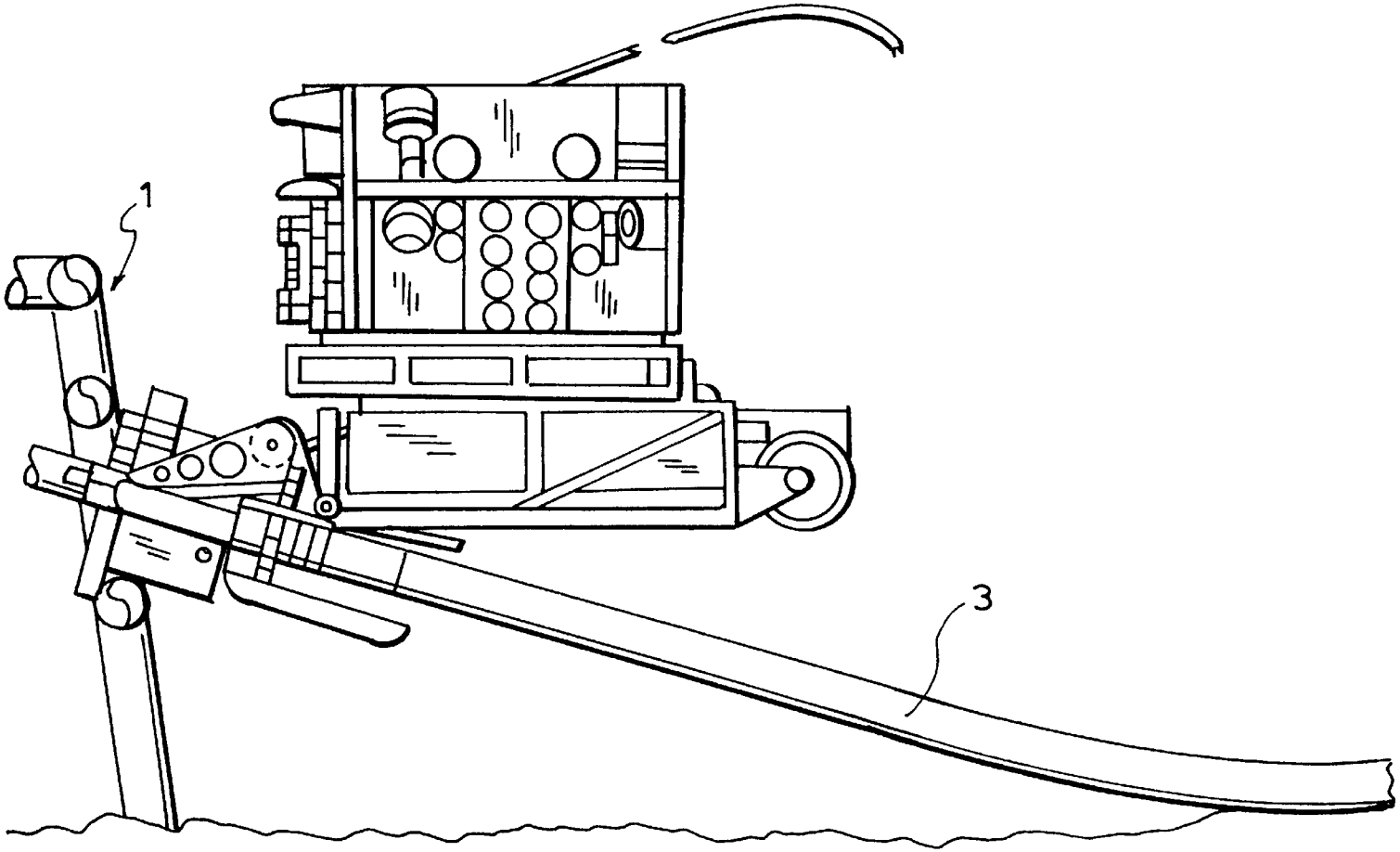

Other advantages and features will become clearer from reading the description of one preferred embodiment of the invention, and from the appended drawings in which:

FIG. 1 is a diagrammatic depiction of a connection between two assemblies to be connected and which can move one with respect to the other, FIGS. 2*a* and 2*b* are perspective views of a receptacle according to one aspect of the invention, FIG. 2*a* not including any locking means, and FIG. 2*b* including locking means, FIGS. 3*a* and 3*b* are perspective views of a remote-operated vehicle used for the connecting of FIG. 1, FIG. 4 is a perspective view of the pivoting front chassis of the vehicle of FIGS. 3*a* and 3*b*, FIG. 5 is a diagrammatic depiction of the means of immobilizing the guiding and centering shafts, FIG. 6 is a diagrammatic and partial depiction of the means of righting and aligning the mobile assembly with respect to the fixed assembly, FIG. 7 is a partially sectioned perspective view of the means of producing a seal between the two ends of the pipes when they are connected, FIG. 8 is a diagrammatic depiction of the purge means, FIGS. 9*a* and 9*b* are perspective views of a buoyancy unit for moving the locking means, FIGS. 10*a* and 10*b* diagrammatically depict two phases in the vehicle's approach towards the fixed structure.

In a system for connecting together two assemblies one of which is considered to be fixed at least during connection and the other of which is mobile, use is generally made of a remote-operated vehicle or ROV. The fixed assembly consists of a fixed structure 1, for example a well head or an underwater manifold, in which one end 2*a* of a pipe 2 is mounted, also fixed. The mobile assembly consists of a flexible pipe 3, whose free end 4, to be connected to the fixed end 2*a* of the pipe 2, is secured to a sled 5 (FIG. 1).

A receptacle 6 (FIG. 2) is secured to the fixed structure 1 in a generally inclined direction so as to make connection easier, the angle of inclination being of the order of 15° to the horizontal, corresponding to the natural angle of a flexible pipe at the moment it is connected to a fixed pipe. The receptacle 6 (FIG. 2*a*) comprises a front wall 7 in which there is formed an opening 8 for accessing the mobile end 4 of the flexible pipe 3, and a rear wall 9 in which there is also formed an orifice 10 for the passage of the fixed end 2*a* to be connected to the mobile end 4. Orifices 10*a* are also made in the rear wall 9 and are used for attaching and positioning the end 2*a* of the fixed pipe 2 with respect to the said wall which constitutes the reference for the positioning of the various elements involved in making the connection. The receptacle 6 also comprises guide housings which are in the shape of funnels 11 and are situated laterally on each side of the access openings 8 and 10, each funnel 11 comprising a slot 12 formed along at least part of an upper generatrix. Above each funnel 11 and preferably offset slightly towards the openings 8 and 10, there is formed a passage 13 for receiving pistons which will be described later. The receptacle 6 also comprises, on at least one of the lateral sides, a frame which consists of lateral plates 14, in which there are formed holes or housings 15 which serve to receive the ballast weights of a buoyancy unit which will be described later. The holes 15 may have different dimensions depending only on the dimensions of the ballast weights, which themselves depend on the weight to be compensated for. A centering hole 15*a* is also provided for receiving a centering peg of the buoyancy unit.

The internal dimensions of the receptacle 6 and especially the distance between the front wall 7 and the rear wall 9 are chosen to be such that the space 16 inside the said receptacle is large enough for the locking means 60, which will be used to lock the connected ends in their final connected position (FIG. 2*b*), to be moved in its entirety. The space 16 is also appropriate for possibly housing inspection means therein.

The vehicle denoted overall by the reference 17 and depicted in FIGS. 3*a* and 3*b* comprises, in the known way, a skid 18, in which there is at least partially housed equipment comprising winches 19 for winding up and paying out hauling cables 20, and all the other accessories needed to move it, such as, for example, the propulsion motors 21.

An important feature of the present invention is that securely mounted on the skid 18 is a front chassis 22 which pivots about a horizontal axis of pivoting 23, so that the said front chassis 22 can pivot with respect to the skid which remains fixed and secured to the vehicle. The front chassis 22 comprises at least two lateral arms 24 which pivot with the said front chassis, the said arms 24 each consisting of a triangular angle iron. To at least one and preferably to each arm 24 there is attached a small thin tube 25 through which there passes a hauling cable which is thus guided. Positioning pegs 26 are provided on the front chassis and serve to connect the said chassis to the sled 5, definitive attachment between front chassis 22 and sled 5 being provided by a catch 27. Each of the arms 24 can be housed at least partially via its vertex part in a slot 28 formed along an upper generatrix in each of at least two hollow guiding and centering shafts 29, the said shafts 29 being secured to the sled 5. When at least the ends or vertices of the arms 24 are located in the corresponding slots 28 in the shafts 29, the hauling cables are approximately centered along the axis of the shafts.

The sled 5 is free to rotate with respect to the mobile pipe 3 thanks to a bearing, but the orientation of the flexible pipe when it consists of a bundle of lines, such as an umbilical, may be determined by an orientation mechanism which may be of a number of types.

A first mechanism may consist of a ring gear mounted on the sled and meshing with a pinion mounted on the vehicle skid.

A second mechanism may consist of a ratchet system, like the one depicted in FIG. 3*b*, which system comprises a ram 31 secured to an arm 31*a* which engages with a cog wheel 30. Orientation, in this case, takes place one step at a time.

When the flexible pipe 3 is in the correct orientation with respect to the sled 5, then a locking pin, not depicted, is engaged to secure the sled and the flexible pipe in the correct orientation.

Once the hauling cables 20 have been attached to the fixed structure or behind the rear wall 9 of the receptacle 6, the vehicle 17 passes over the sled 5, by making the front chassis 22 pivot so as to allow the vertices of the arms 24 to enter the slots 28 in the guiding and centering shafts 29, then the sled 5 and the front chassis are secured together. In a first phase, the mobile pipe is dragged along the sea bed (FIG. 1). In a second phase (FIG. 10*a*), the hauling on the cables 20 raises the end 4 of the flexible pipe, the angle of inclination α increasing steadily as the fixed structure 1 is approached, which fixed structure lies at a higher level (FIGS. 10*a* and 10*b*). Throughout the movement of the mobile pipe 3, the vehicle remains in an approximately horizontal position because only the front chassis 22 pivots about the axis of pivoting in order to compensate for the inclination of the mobile flexible pipe 3 between its starting position and the position it has when it reaches the fixed structure 1. During the phase of engaging the mobile pipe 3 in the receptacle 6, it is first of all the shafts 29 which enter the receiving funnels 11 and the arms 24 which enter the slots 12 in the said funnels. Throughout the connecting operation, the hauling cables remain perfectly along the axis of the shafts 29 thanks to the fact that they are kept guided in the small tubes 25 secured to the arms 24. When the shafts 29 enter the funnels, locking latches 32 located in the receptacle hold each shaft 29 in a reference position so as to prevent any movement (FIG. 5). The locking of each shaft 29 in the reference position is determined in such a way that a certain distance is left between the ends to be connected so as to allow possible intervention within the receptacle, such as, for example, the changing and/or inspecting of the means of locking the said ends. Quite obviously, the fixed structure and/or the vehicle can be fitted with visual indicators which indicate whether the locking latches are in the open or closed position. A lever mechanism 33 is also provided to keep each corresponding locking latch in the open or in the closed position. When the sled 5 is thus connected to the receptacle 6, the vehicle can be recovered and used for other functions if necessary.

To assist with the engagement phase, and because of the enormous weights involved when making the connection, which weights may sometimes be as much as 60 tonnes (FIG. 6), rams 34*b* (or push-pull cylinders) attached to the front chassis 22 are actuated in such a way that the pistons 34 are introduced into the passages 13 of the receptacle 6. After introduction, the pistons 34 are locked in their working position and the assembly consisting of the sled 5 and of the mobile pipe 3 is righted so that the shafts 29 are aligned with the axis of the funnels 11. The distance d separating the axis 34*a* of the pistons 34 from the axis 29*a* of the shafts 29 is determined in such a way as to create a large enough moment to right the sled and the shafts.

When the mobile end 4 and the fixed end 2*a* are in their correct position for connecting, that is to say when the male part 35 of the mobile end 4 fits into the female part 36 of the fixed end 2*a* (FIG. 7), with the insertion of a sealing gasket 37 between the said male and female parts, purging is carried out in order to expel any residual water which may lie on each side of the gasket. For this, the fixed end 2*a* comprises two nozzles 38, 39 which are connected to two purge valves 40, 41 (FIG. 8), the nozzles 38, 39 ending respectively at the top and at the bottom of the said fixed end. During the gasket leak test procedure, there is first of all purging with an inert gas, for example nitrogen, so as to drive out the water that lies between the gasket and the male and female parts 35, 36, then a pressure of approximately 50 bar is applied by closing, for example, the valve 41, so as to leak test the joint. Thus the leak test is a test with gas rather than a test with water because the water has been expelled.

When a mobile flexible pipe which consists of a collection of lines and/or cables such as umbilicals for example is being connected, the final radial orientation of the assembly is completed and provided for using fingers borne by the mobile end 3 which engage in orientation guides 42 formed on the fixed end 2*a* (FIG. 3*b*).

The vehicle 17 also comprises a buoyancy unit 43 (FIGS. 9*a* and 9*b*) which is used to compensate for the weight of the locking means 60 when these are being moved inside the receptacle 6. The unit 43 comprises buoyancy material 44, such as a synthetic foam, and weights or ballast weights 45 which are engaged in the housings 15 produced for this purpose in the receptacle 6 before the locking means are gripped and moved. In fact, the weight of the ballast weights is determined as a function of the weight of the locking means. The unit 43 is positioned on the receptacle 6 by mobile pegs 46 which engage in the holes 15*a* of the said receptacle. All these functions of engaging and of fitting the ballast weights into the housings then of gripping and moving the locking means are carried out by the vehicle sequentially and very accurately.

Another special feature of the present invention is that the end of the hauling cables to be attached to the fixed structure or to the receptacle are fitted with end terminations which can be installed in situ, this operation consisting in introducing the cable into a small hollow cylinder, in splaying the strands of the cable and, on the outside around the cylinder, in introducing into the heart of the cable a stud which is driven into the cable until it is fully introduced.

I claim:

1. A system for connecting a first assembly and a second assembly, wherein the second assembly is relatively movable with reference to the first assembly, the system comprising:

the second assembly comprising a vehicle including propulsion means for moving the vehicle with reference to the first assembly; a hauling element on the vehicle and attachable to the first assembly during the connecting; a winch on the vehicle to which the hauling element is connected and the winch being operable for drawing the hauling element onto the vehicle, for hauling the vehicle toward the first assembly;

a skid attached to the vehicle and the hauling element being guided off the vehicle by the skid;

the vehicle including a front chassis connectable with the skid, a pivot axis connecting the front chassis to the vehicle such that the chassis may pivot around the pivot axis with respect to the vehicle; the hauling element extending between the front chassis and the first assembly; the front chassis being pivotable such as the second assembly is moved toward the first assembly, the vehicle may be kept in a first orientation as the front chassis pivots for retaining the hauling element in a selected variable orientation with reference to the first assembly as the hauling element moves the front chassis and the second assembly toward the first assembly for connecting them; attaching elements for attaching the first and second assemblies.

2. The system of claim 1, wherein the vehicle is a remote operated vehicle.

3. The system of claim 1, wherein the vehicle is retained in an approximately horizontal position and the pivot axis for the front chassis is also approximately horizontal.

4. The system of claim 1, further comprising at least two arms attached to the front chassis and extending toward and being engagable with the first assembly for aiding in positioning of the first and second assemblies when the second assembly is moved toward the first assembly.

5. The system of claim 4, further comprising rams on the front chassis and spaced from the arms a distance around the pivot axis and engagable with the first assembly, the rams being operable upon engagement with the first assembly for movement with respect to the arms and the second assembly for controlling and righting the second assembly with reference to the first assembly.

6. The system of claim 1, further comprising rams on the front chassis and engagable with the first assembly, the rams being operable upon engagement with the first assembly for movement with respect to the second assembly for controlling and righting the second assembly with reference to the first assembly.

7. The system of claim 4, wherein the hauling element comprises a cable and further comprises a thin tube at at least one of the arms for guiding and centering the hauling element cable as the front chassis pivots.

8. The system of claim 1, further comprising a sled on which the front chassis is supported and the sled is part of the second assembly; and the vehicle is separably attached to the second assembly.

9. The system of claim 8, wherein the sled has at least two hollow guiding and centering shafts, the first stationary assembly includes respective reception members for receiving the shafts; and each of the shafts having a slot approximately along an upper generatrix thereof.

10. The system of claim 9, further comprising at least two arms attached to the front chassis and extending toward and being engagable with the first assembly for aiding in positioning of the first and second assemblies when the second assembly is moved toward the first assembly;

a respective one of the centering shafts on the sled for at least one of the arms of the front chassis, and the centering shaft being so oriented that the slot in the centering shaft comprises a housing for the free end of the respective arm.

11. The system of claim 10, wherein the hauling element comprises a cable and further comprises a thin tube at at least one of the arms for guiding and centering the hauling element cable as the front chassis pivots; the hauling cable passing through the tube and being also positioned on the axis of the corresponding shaft.

12. The system of claim 10, wherein each of the arms which is received in a slot in a respective one of the centering shafts includes a triangular shape part with a vertex housed in the slot of the respective centering shaft.

13. The system of claim 5, comprising two of the arms and two of the rams between the arms, each of the rams including a piston having an extended and a retractable position, and passages in the first assembly for receiving the rams in their extended positions and the rams being movable between their positions for bringing the attaching elements together.

14. The system of claim 13, wherein the piston of each ram is movable at an angle in the first assembly for accomplishing the final axial positioning of the second assembly with respect to the first assembly.

15. The system of claim 1, wherein the first and second assemblies to be connected lay approximately at the same levels prior to connection.

16. The system of claim 1, wherein the first and second assemblies to be connected lay at different levels prior to connection.

17. The system of claim 1, wherein the vehicle comprises a water buoyancy unit separable from the front chassis.

18. The system of claim 1, wherein the second assembly includes a flexible pipe attached to the front chassis, the flexible pipe having a first connectable free end, the first assembly includes a second fixed end to which the first free end is to be connected, and the first assembly comprises a fixed structure to which the second fixed end is mounted.

19. The system of claim 18, further comprising a fixed pipe wherein the second fixed end is part of the fixed pipe, and the fixed pipe is oriented so that the second fixed end forms an angle with respect to the horizontal that is approximately equal to the natural angle of the flexible pipe at the free end thereof.

20. The system of claim 19, wherein the angle of the fixed pipe with respect to the horizontal is about 15°.

21. The system of claim 18, wherein the flexible pipe is freely rotatable with respect to the front chassis; an orientation mechanism at the front chassis for holding the flexible pipe at a selected orientation for enabling attachment of the first and second assemblies.

22. The system of claim 21, further comprising positioning members provided at the first and second ends of the flexible and fixed pipes for effecting a selected final positioning of the connection between the first and second ends.

23. The system of claim 1, wherein the second movable assembly includes a flexible pipe attached to the front chassis, the flexible pipe having a first connectable free end and the first assembly includes a second fixed end to which the first free end is to be connected, the first assembly comprising a fixed structure to which the second fixed end is mounted;

a receptacle mounted on the first assembly; the first end and the fixed end which are to be connected together opening into the receptacle; locking elements in the receptacle for connecting the first and second ends, the receptacle having a space large enough to allow the locking elements to be moved in their entirety and in the axial direction of the first end after the first end has been disconnected from the second end.

24. The system of claim 23, wherein the receptacle includes a rear wall to which the second fixed end is attached, and the rear wall serving as a reference for positioning and centering of elements of the second movable assembly involved in connecting the assemblies.

25. The system of claim 23, wherein the receptacle includes guide housings formed on each side of the opening to the receptacle for the first and the second pipe ends;

centering members secured to the first free end of the flexible pipe, and the centering members being receivable in the guide housings.

26. The system of claim 25, wherein each of the housings is slotted along at least a part of an upper generatrix.

27. The system of claim 25, wherein each guide housing has a general shape of a guide funnel narrowing into the housing.

28. The system of claim 25, further comprising upper passages formed in the receptacle at a location above the guide housing.

29. The system of claim 28, further comprising at least two arms attached to the front chassis and extending toward and being engagable with the first assembly for aiding in positioning of the first and second assemblies when the second assembly is moved toward the first assembly;

rams on the front chassis and spaced from the arms a distance around the pivot axis and the rams being received in the upper passages of the first assembly, the rams being operable upon engagement with the first assembly for movement with respect to the arms and the second assembly for controlling and righting the second assembly with reference to the first assembly.

30. The system of claim 25, further comprising means for immobilizing the guiding and centering members in the guide housing.

31. The system of claim 23, further comprising the receptacle including a frame for temporarily receiving ballast weights for the receptacle.

32. A method for connecting a first end of a mobile pipe to a second end of a fixed pipe that is secured to a fixed structure, the method comprising:

mounting a receptacle on the fixed structure, attaching locking means to the receptacle, fixing the second end of the fixed pipe to the receptacle toward the locking means;

moving the first end of the mobile pipe toward the second end of the fixed pipe; moving a plurality of guiding and centering shafts which are located at and secured to the mobile pipe into respective guide housings of the receptacle for guiding the mobile pipe to the fixed pipe; reorienting the first end of the mobile pipe in order to align the first and second ends of the pipes to be connected together in an axial direction;

continuing movement in an axial direction of the mobile pipe until the first and second ends are connected together; placing a sealing gasket between the first and second ends as they are being connected together; actuating purge means for purging any fluid that might be present between the sealing gasket and at least the connection thereto at the second fixed end;

locking the first and second ends in their final connected positions.

33. The method of claim 32, further comprising using a remote operated vehicle for moving the mobile first end toward the fixed second end;

anchoring hauling cables to the receptacle; passing the hauling cables through a guide housing formed on the receptacle; attaching a pivotable front chassis which pivots with respect to the vehicle to a sled to which the first end is attached; moving the vehicle and the sled including the front chassis toward the second fixed end while the vehicle is being kept approximately horizontal irrespective of the angle that the first mobile end makes with the respect to the horizontal.

* * * * *